US010448462B2

(12) United States Patent
Flesch

(10) Patent No.: US 10,448,462 B2
(45) Date of Patent: Oct. 15, 2019

(54) HOUSEHOLD APPLIANCE WITH A CONTROL DEVICE

(71) Applicant: BSH Hausgeräte GmbH, Munich (DE)

(72) Inventor: Sebastien Flesch, Gerstheim (FR)

(73) Assignee: BSH Hausgeräte GmbH, Munich (DE)

( * ) Notice: Subject to any disclaimer, the term of this patent is extended or adjusted under 35 U.S.C. 154(b) by 60 days.

(21) Appl. No.: 15/120,535

(22) PCT Filed: Feb. 5, 2015

(86) PCT No.: PCT/EP2015/052399

§ 371 (c)(1),
(2) Date: Aug. 22, 2016

(87) PCT Pub. No.: WO2015/124434

PCT Pub. Date: Aug. 27, 2015

(65) Prior Publication Data

US 2017/0013680 A1 Jan. 12, 2017

(30) Foreign Application Priority Data

Feb. 24, 2014 (EP) ..... 14290048

(51) Int. Cl.

| | |
|---|---|
| ***H05B 6/06*** | (2006.01) |
| ***F24C 7/08*** | (2006.01) |
| ***G05G 1/10*** | (2006.01) |
| ***D06F 39/04*** | (2006.01) |
| *D06F 39/00* | (2006.01) |
| *G05G 1/08* | (2006.01) |
| *G05G 5/03* | (2008.04) |

(52) U.S. Cl.

CPC ..... *H05B 6/062* (2013.01); *D06F 39/045* (2013.01); *F24C 7/082* (2013.01); *G05G 1/10* (2013.01); *D06F 39/005* (2013.01); *G05G 1/08* (2013.01); *G05G 5/03* (2013.01)

(58) Field of Classification Search

CPC ..... H05B 6/062; D06F 39/045; D06F 39/005; F24C 7/082; G05G 1/10

USPC ..... 219/137.7, 442, 481, 492, 506, 519, 62, 219/63, 622, 625, 660, 663

See application file for complete search history.

(56) References Cited

U.S. PATENT DOCUMENTS

| | | | |
|---|---|---|---|
| 4,947,097 | A | 8/1990 | Tao |
| 6,480,752 | B1 | 11/2002 | Blume et al. |

(Continued)

FOREIGN PATENT DOCUMENTS

| | | | |
|---|---|---|---|
| DE | 102006057311 | A1 | 5/2008 |
| DE | 102012201195 | A1 | 8/2013 |
| WO | 2009024231 | A1 | 2/2009 |

OTHER PUBLICATIONS

International Search Report PCT/EP2015/052399 dated Apr. 9, 2015.

National Search Report CN 201580010138.2 dated Jun. 14, 2017.

*Primary Examiner* — Christopher S Kim

(74) *Attorney, Agent, or Firm* — Michael E. Tschupp; Andre Pallapies; Brandon G. Braun

(57) ABSTRACT

A domestic appliance includes at least one manually operable longitudinally or rotationally movable control device which is configured to adopt several latching positions. The latching positions are variably adjustable, for example adjusting a number of latching positions, or by adjusting a spacing between adjacent latching positions, or by adjusting a latching sensation of the latching positions.

14 Claims, 3 Drawing Sheets

(56) References Cited

U.S. PATENT DOCUMENTS

| | | | | |
|---|---|---|---|---|
| 2002/0057152 | A1 | 5/2002 | Elferich et al. | |
| 2006/0255683 | A1 | 11/2006 | Suzuki et al. | |
| 2008/0282902 | A1* | 11/2008 | Dayton ..... | F24C 7/082 99/331 |
| 2012/0012010 | A1 | 1/2012 | Baraille et al. | |
| 2012/0042745 | A1 | 2/2012 | Hamm et al. | |
| 2012/0092139 | A1 | 4/2012 | Ehrensberger et al. | |

* cited by examiner

HOUSEHOLD APPLIANCE WITH A CONTROL DEVICE

CROSS-REFERENCES TO RELATED APPLICATIONS

This application is the U.S. National Stage of International Application No. PCT/EP2015/052399, filed Feb. 5, 2015, which designated the United States and has been published as International Publication No. WO 2015/124434 and which claims the priority of European Patent Application, Serial No. 14290048.9, filed Feb. 24, 2014, pursuant to 35 U.S.C. 119(a)-(d).

BACKGROUND OF THE INVENTION

The invention relates to a domestic appliance with at least one manually operable longitudinally or rotationally movable control device, which control device can adopt several latching positions. The domestic appliance may be a cooking appliance or a laundry care appliance in particular.

In the field of automotive technology, control knobs arranged, for example, on a central console are known (e.g. the so-called iDrive Controller by BMW), which are able to change their number of latching positions according to the operating mode.

DE 197 12 049 A1 discloses, in the field of automotive technology, an operating apparatus for manually inputting information into a device, having a final control element whose position can be changed under the effect of an activation force and which is connected to a converter for generating electrical signals which characterize the position of the final control element, and having a motor element which is connected to the final control element and which, under the control of the electrical signals, exerts a force on the final control element, the size and direction of which force is dependent on the position of the final control element and/or on the information which is to be input, wherein there is provision for the converter to be composed of the rotor of the motor element and sensors which respectively emit an electrical signal as a function of the position of the rotor.

DE 100 29 191 A1 discloses, in the field of automotive technology, an operating element with a rotary knob, a magnetic circuit and at least one coil. It is provided that the rotary knob is rotatably mounted with respect to at least one part of the magnetic circuit, that the gap located between the rotary knob and magnetic circuit is filled with a magnetorheological liquid and that the coil is provided to produce a variable braking effect on the rotary knob.

For domestic appliances, rotary knobs with fixed, mechanically predefined latching positions are currently known, the rotational position of which can be detected electromechanically, visually or magnetically for instance. Furthermore, for domestic appliances there are knobs without latching positions, which can rotate freely, e.g. so-called "bit generators". Magnetically fastened, removable knobs without latching positions are also known, which can likewise rotate freely, e.g. a so-called "twist pad".

The object of the present invention is to overcome the disadvantages of the prior art for domestic appliances at least in part and in particular to enable an operation for electrically operable domestic appliances with diverse applications and which is particularly user-friendly.

This object is achieved according to the features of the independent claims. Preferred embodiments may be derived in particular from the dependent claims.

The object is achieved by a domestic appliance with at least one manually operable longitudinally or rotationally movable control device, which control device can adopt several latching positions, wherein the latching positions can be variably adjusted.

The advantage of this is that a control device can be installed in many different domestic appliances, which enables a cost-effective manufacture and lower storage expenses. In addition, a haptic sensation (e.g. a latching sensation) can be adjusted more accurately, which improves ease of use. Moreover, the haptic sensation can also be changed subsequent to the installation into a domestic appliance, which improves ease of use even further.

The control device may have in particular a handle element for its manual operation by a user or operator of the domestic appliance. The control device may also be referred to as an operating device or operating element.

BRIEF SUMMARY OF THE INVENTION

In a further development, at least one control device is a longitudinally movable control device, e.g. a slider with several latching positions.

In one development, at least one control device is a rotationally movable control device, e.g. a rotary switch, a rotary actuator or a rotary knob.

In particular, a button may not be considered a longitudinally or rotationally movable control device.

A latching position may be in particular a position of the control device, in which an operator experiences a latching sensation or, more specifically, a latching haptic sensation. The latching position may be an intermediate position which lies between two other latching positions and/or it may be an end position. With a longitudinally movable control device (e.g. a slider), the two end positions are mechanically predefined. With a rotationally movable control device (e.g. a rotary knob), there are no mechanically predefined end positions in particular, but rather the rotationally movable control device may in particular be mechanically spun. The rotationally moveable control device is then unable to be damaged due to overrotating as a result. The latching positions are not mechanically predefined in particular, but rather non-mechanical forces or movement resistances can be generated by a targeted activation, e.g. by activating a magnetic force. The latching positions and/or the haptic sensation(s) thereof can be generated in the same way as the principles disclosed in DE 197 12 049 A1 and DE 100 29 191 A1.

The domestic appliance is in particular an electrically operable domestic appliance. The domestic appliance may be a large domestic appliance or a small domestic appliance. The large domestic appliance may be, for example, a cooking appliance such as a hob, an oven, a cooker, a steam cooking appliance etc, may be a laundry care appliance such as a washing machine and/or a tumble dryer, may be a dishware appliance such as a dishwasher and/or a dishware sterilizer or may be a refrigeration appliance such as a refrigerator and/or a chest freezer. The small domestic appliance may be, for example, a toaster, a coffee machine etc. The domestic appliance may also be or have, for example, an extractor hood.

In one embodiment, the variable adjustability of the latching positions includes the number of latching positions being adjustable. For example, a control device for hobs may have ten latching positions (e.g. for a gas cooker), twelve latching positions (e.g. for an induction cooker) or eight latching positions (e.g. for a teppanyaki griddle). The same type of control device may also be used for different hobs in different latching configurations. In this case, a control device may be used as a cooking level controller. Precisely one control device may be provided for several cooking zones. Alternatively, for each cooking zone there may be one control device in each case.

A control device for ovens may have several latching positions which can be assigned to particular cooking programs. In addition, a control device used as a temperature setting device may have around 50 latching positions, e.g. for adjusting a temperature range between 50° C. and 300° C. A control device for adjusting a timer may have e.g. 60 latching positions, for example for adjusting a time or duration in steps of seconds or minutes. Precisely one control device may be provided for several functions of the domestic appliance. Alternatively, several control devices may be provided, e.g. control devices for at least two different functions in each case.

In a further embodiment, the variable adjustability of the latching positions comprises a spacing between adjacent latching positions being adjustable. For example, a spacing between two latching positions may be adjusted to be closer if the number of latching positions increases. The spacing between adjacent latching positions may be adjusted equally for all latching positions, or may be adjusted differently for at least two pairs of adjacent latching positions.

In another embodiment, the variable adjustability of the latching positions comprises a latching sensation or a haptic sensation of the latching positions being adjustable. For example, a harder or softer feeling latching or latching sensation may be adjusted. This may, for example, be achieved through a variation of a rotary resistance in the case of a rotationally movable control device or by a variation of a force required to switch to the next latching position. The rotary resistance or the force may, for example, be varied in its (latching) profile, which comprises in particular the shape and/or height. An end position can be characterized by a very high movement resistance or a very high force to be applied.

In another embodiment, at least two latching positions are assigned a different latching sensation or at least two latching positions have a different latching haptic sensation. In other words, each latching position may be assigned an individually adjustable latching sensation. For example, two latching positions may be embodied as end positions and the latching positions between these two points may be embodied as intermediate positions. In this case, a usable rotational range between the two end positions may be restricted in a targeted manner Adjacent intermediate positions may also have a different latching sensation. For example, latching positions which can be successively switched through may be assigned a gradually harder or softer feeling latching or latching sensation.

In a further embodiment, the latching positions of at least one control device of the domestic appliance can be varied depending on a function of the control device. This can also be referred to as a "mode change". For example, a control device of a hob or cooker may have a first number of latching positions if it is provided for adjusting a cooking level of a particular cooking zone, and may have another number of latching positions if it is provided for adjusting a timer. In addition or alternatively to the number of latching positions, the switching may change a spacing and/or a haptic sensation of the latching positions. A control device embodied in this manner is particularly suitable for replacing several conventional control devices.

Switching between the different functions can take place automatically on the part of the domestic appliance, by actuating at least one button provided for this purpose ("switching button" or "function selection button") or, in the case of a rotationally movable control device, by pressing the control device, if this is embodied as a rotary/pressure actuator. This embodiment enables a control device to be used in a particularly user-friendly manner as an operating device for several functions of a domestic appliance.

Furthermore, in one embodiment the domestic appliance is configured to operate other domestic appliances and the control device can be used as an operating element for at least one other domestic appliance. For example, a hob or a cooker can be configured to operate an extractor hood or chimney hood, wherein a control device of the hob or cooker can then be used to adjust a suction level, for example. The latching positions can be adjusted according to this function of the extractor hood.

In another embodiment, the control device has adjustment electronics for adjusting the latching positions (number, spacing, latching profile or haptic sensation), the adjustment electronics is coupled to a control facility of the domestic appliance, and data for adjusting the adjustment electronics can be sent by the control facility. This enables a particularly simple and diverse adjustment of the control device. For example, data on latching positions is stored in the domestic appliance, which enables the control device to perform at least one function. This data includes, for example, information on the number, spacing, latching profile and haptic sensation etc. of the latching positions. This data can also be referred to as "configuration data". If a control device is, or is to be installed in the domestic appliance, it can receive said data from the domestic appliance and convert it by means of the adjustment electronics for operation, e.g. into suitable electric currents of an electromagnet. If a function of the control device is to be changed, new data just has to be transmitted from the domestic appliance to the control device.

In an additional embodiment, the domestic appliance has a control facility for adjusting the latching positions. The control device then does not need to have any adjustment electronics in particular, but rather is controlled entirely by the domestic appliance. This enables a particularly simple embodiment of the control device.

A possible rotationally movable control device (e.g. a rotary knob) may have, for example, at least one electromagnet which adjusts a haptic sensation for a rotation by the operator by means of a strength or an intensity of a current conducted through the electromagnet. A rotational position of the control device may be determined by means of an encoder, for example. Depending on the rotational position and optionally direction of rotation, a controller (e.g. the adjustment electronics of the control device or the control electronics of the domestic appliance) induces a more or less intense current flow, so that the operator experiences latching sensations.

A further possible rotationally movable control device has a multiphase motor, which has a drive axle connected to a handle element of the control device. The drive axle can in particular rotate freely. The drive motor can be driven by means of a controller (e.g. the adjustment electronics or the control electronics of the domestic appliance) such that an operator rotating the handle element experiences latching sensations as a result. For this purpose, a more or less intense current flow may be conducted through the multiphase motor.

This control device with multiphase motor has the advantageous development that it, in particular its handle element, can be embodied so that it can be automatically rotated by the domestic appliance. For example, the domestic appliance may be a cooking appliance, which has a quick-heat function with particularly high heating power. After being manually adjusted to a latching position corresponding to the quick-heat function, once the quick-heat phase has concluded the control device may automatically rotate itself or the handle element into another latching position which does not correspond to a quick-heat function, but rather to a lower heating power, for example. In another example, the domestic appliance may be a cooking device which has a timer function. The control device may return itself or the handle element to a neutral position once a timer duration has expired and therefore switch off a heating function. The control device may also rotate itself or the handle element by remote control. In addition, a vibration of the handle element can thus be generated for an improved haptic feedback in a simple manner.

BRIEF DESCRIPTION OF THE DRAWINGS

The above-described characteristics, features and advantages of this invention, as well as the manner in which these are realized, will become more clearly and easily intelligible in connection with the following schematic description of an exemplary embodiment which is explained in more detail in connection with the drawings. For clarity of illustration identical elements, or elements having an identical effect, are given identical reference characters.

DETAILED DESCRIPTION OF EXEMPLARY EMBODIMENTS OF THE PRESENT INVENTION

Figure 1:
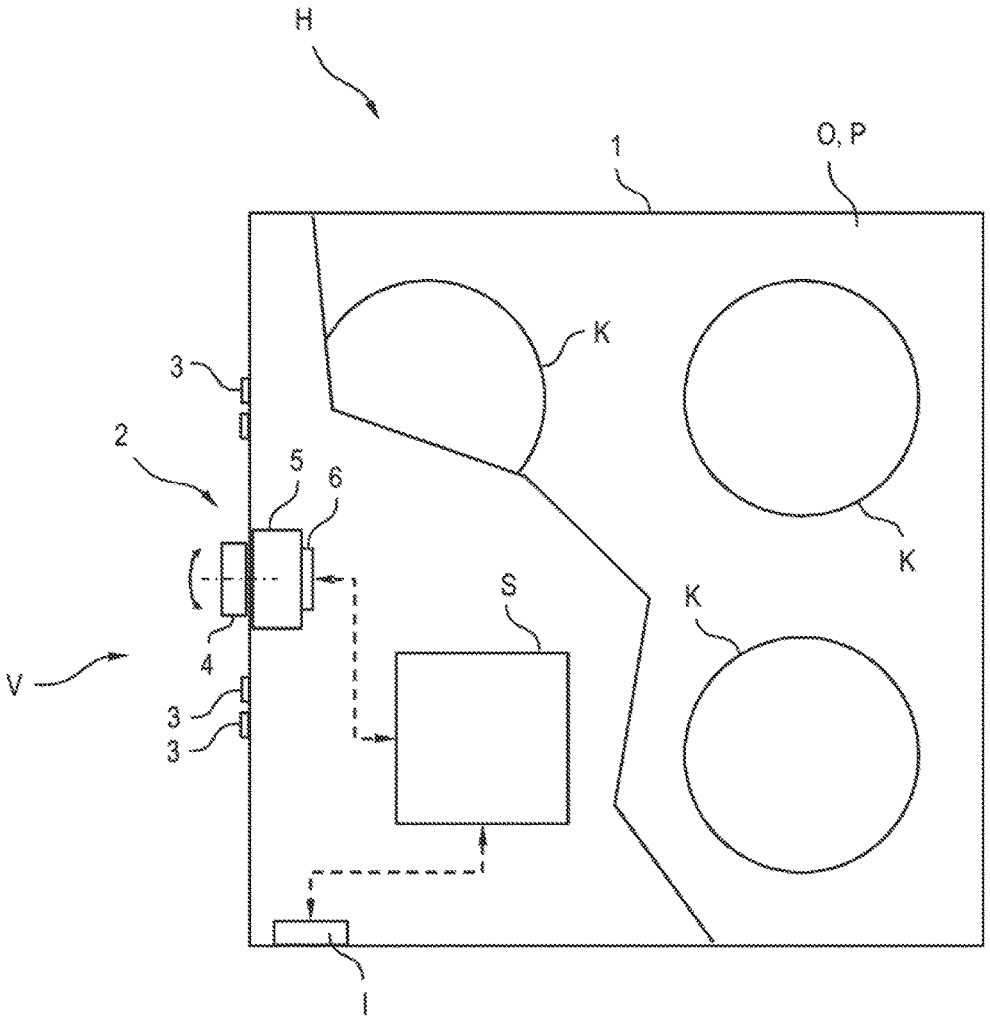
FIG. 1 shows a sectional representation in plan view of a domestic appliance according to the invention in the form of a cooking appliance, which has a hob.

FIG. 1 shows a sectional representation in plan view of a domestic appliance according to the invention in the form of a cooking appliance H, which has a hob 1. The cooking appliance H may be the hob 1 as a stand-alone appliance or a combined oven/hob or cooker. On a front side V of the cooking appliance H a manually rotatable control device is located in the form of a rotary actuator or rotary knob 2 and several function selection buttons 3. A display unit or further operating elements (not shown) may also be provided, for example. A hotplate P with several cooking zones K is provided on a top side O. The hotplate P is shown in a partially cutaway view. The cooking zones K are actuated in a fundamentally known manner by means of a central control facility S.

Figure 2:
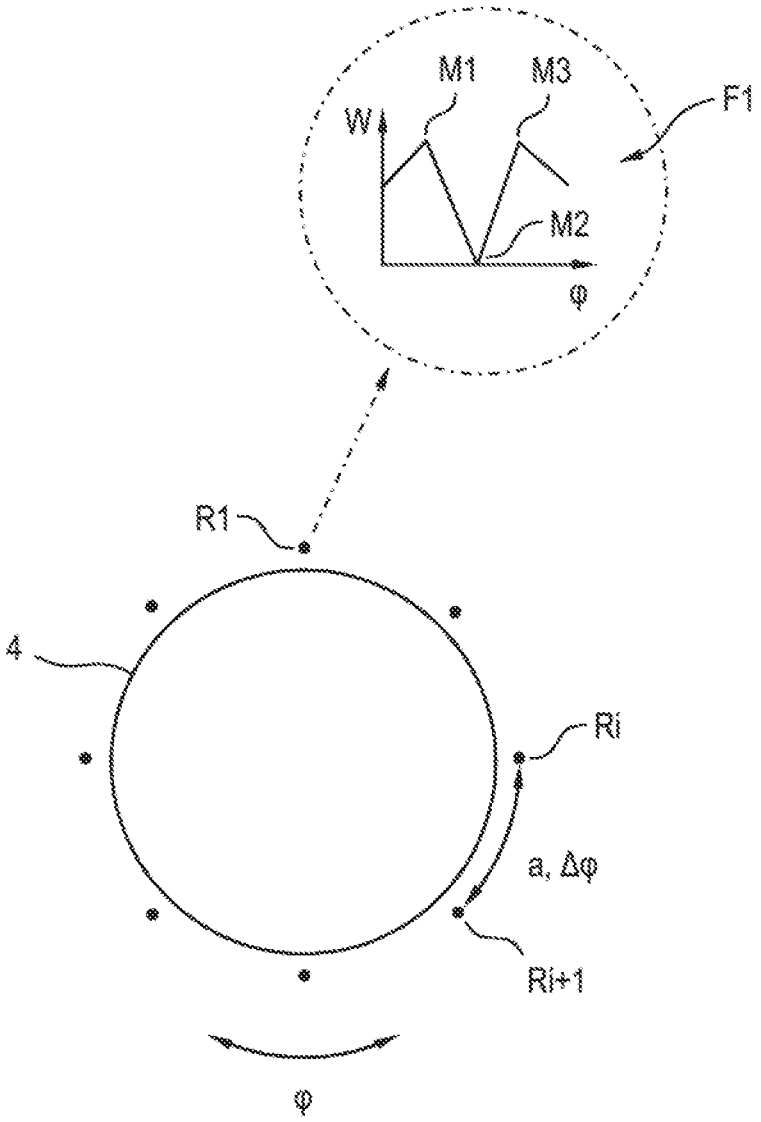
FIG. 2 shows a front view of a handle element of the cooking appliance.

The rotary knob 2 has an outside handle element 4, which is connected via a drive shaft (not shown) to an electric multiphase motor 5 arranged inside the cooking appliance H. The rotary knob 2 also has drive electronics or adjustment electronics 6 for operating the electric multiphase motor 5. The adjustment electronics 6 can operate the multiphase motor 5 in particular in such a way that the motor, as shown more precisely in FIG. 2, can assume several (virtual) latching positions Ri, where here i=. . . n=8, which are sensed by the operator in a manner similar to mechanical latching positions. Each of the latching positions Ri can in this case be assigned a particular latching sensation by the adjustment electronics 6 by suitable operation of the multiphase motor 5. A spacing a of adjacent latching positions Ri, Ri+1 can be defined, for example, via an arc length or as an angular difference $\Delta\varphi$ of the angle of rotation $\varphi$.

This latching sensation for the latching position R1 can be defined, for example, by means of a latching profile F1, which is shown here as a plotting of an rotary resistance W over an angle of rotation $\varphi$ for the latching position R1. With a clockwise rotation, when approaching the latching position R1 a local maximum resistance M1 must first be overcome in order to arrive at a rest position M2. In order to rotate further into the next latching position, a local maximum resistance M3 must again be overcome. The local maximum resistances M1 and M3 may be embodied to be equal or different.

Since the latching positions Ri are not mechanically predefined, but rather are only emulated by the suitable operation of the multiphase motor 5, they may be variably adjusted, e.g. with respect to their number n, their spacing a and/or their latching profile Fi. Thus, at least two latching positions, e.g. Ri and Ri+1, can be assigned a different latching profile Fi and Fi+1, respectively.

Returning once more to FIG. 1, the latching positions Ri of the rotary knob 2 can be varied depending on a function allocated to the rotary knob 2. Thus, the rotary knob 2 may be used to operate one of the cooking zones K with a particular latching configuration, which determines e.g. the number n of latching positions Ri, their spacing a and/or their latching profile Fi. To adjust a timer, the rotary knob 2 may be operated with another latching configuration. The function selection buttons 3 can be operated to change the function assigned to the control device 4.

The adjustment electronics 6 is coupled to the control facility S of the domestic appliance to vary the latching configuration. If the control facility S recognizes that a function selection button 3 has been operated, it sends the configuration data belonging to the selected function to the adjustment electronics 6. The adjustment electronics 6 in turn controls the multiphase motor 5 for converting the latching positions n, a and F defined by the configuration data.

The control facility S may also automatically operate the multiphase motor 5 in order to rotate the handle element 4, for example.

It is also possible to operate other domestic appliances (not shown) positioned remotely by means of the cooking appliance H. The rotary knob 2 can then be used as an operating element for at least one other domestic appliance. For this purpose, the cooking appliance H, in particular its control facility S, may be coupled to a data communication interface I for communication with at least one other domestic appliance arranged remotely. The data communication interface I may be a wire-bound and/or wireless data communication interface, e.g. a radio module.

Figure 3:
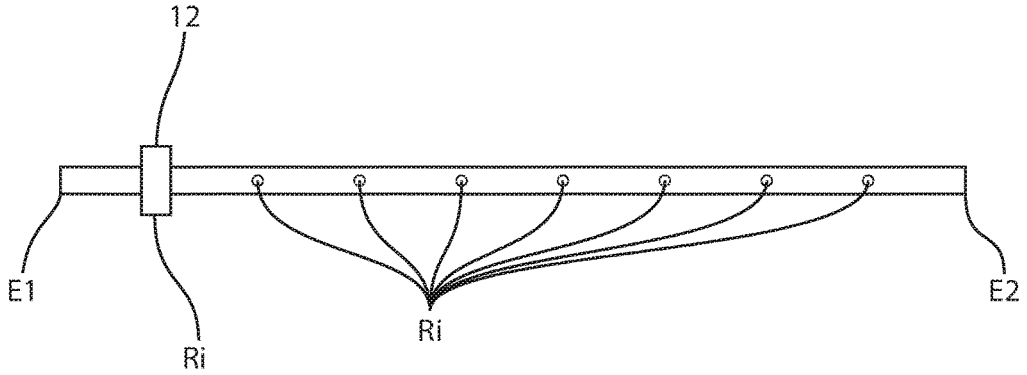
FIG. 3 shows a front view of an exemplary embodiment of the invention.

As shown in FIG. 3, some embodiments of the invention include a manually operable longitudinally movable control device 12, which control device 12 can adopt several latching positions Ri, wherein the latching positions can be variably adjusted. Longitudinally movable control device 12 can be a slider with several latching positions Ri, where i can be any number. With longitudinally movable control device 12, the two end positions E1 and E2 are mechanically predefined and latching positions Ri are defined by and operate under the applicable features described above with relation to the rotatable embodiments.

The present invention is of course not restricted to the exemplary embodiment shown.

In general, "a", "one" etc. can be regarded as a singular or a plurality, in particular in the sense of "at least one" or "one or more" etc., as long as this is not explicitly excluded, e.g. by the expression "precisely one" etc.

In addition, a given number can include precisely the number given and also a conventional tolerance range, as long as this is not explicitly excluded.

The invention claimed is:

1. A domestic appliance, comprising:

at least one manually operable longitudinally or rotationally movable control device having a plurality of latching positions, the control device being configured to control multiple different functions of the domestic appliance;

adjustment electronics electrically coupled to the control device; and a control facility electrically coupled to the adjustment electronics, wherein each of the latching positions has a characteristic that is electronically adjusted by the adjustment electronics in response to data sent by the control facility to the adjustment electronics, the adjustability of the characteristic is variable, and the variability of the adjustability of the characteristic is dependent on which of the functions of the domestic appliance the control device is controlling.

2. The domestic appliance of claim 1, wherein the adjustable characteristic of the latching positions is a number of latching positions.

3. The domestic appliance of claim 1, wherein the adjustable characteristic of the latching positions is a spacing between adjacent latching positions.

4. The domestic appliance of claim 1, configured to operate at least one other domestic appliance, with the control device representing an operating element for the at least one other domestic appliance.

5. The domestic appliance of claim 1, wherein said control device is constructed as a rotationally movable control device and has a handle element and a multiphase motor having a drive axle which is connected to the handle element of the control device, said multiphase motor being driven by the control facility such that an operator rotating the handle element experiences a latching sensation, said control device being automatically rotatable by the control facility.

6. The domestic appliance of claim 1, wherein the characteristic of the latching positions is a latching sensation of the latching positions.

7. The domestic appliance of claim 6, wherein different latching sensations are assigned to at least two of the latching positions.

8. The domestic appliance of claim 1, wherein the at least one manually operable control device is a longitudinally movable control device.

9. The domestic appliance of claim 1, wherein the at least one manually operable control device is a rotationally movable control device.

10. The domestic appliance of claim 1, wherein each of the latching positions are defined by movement resistance generated by a magnetic force.

11. The domestic appliance of claim 1, wherein the control facility assigns a first definition of the adjustable characteristic to each of the latching positions in a first assignment, the control facility assigns a second definition of the adjustable characteristic to each of the latching positions in a second assignment, the first assignment controls a first one of the functions of the domestic appliance, the second assignment controls a second one of the functions of the domestic appliance, and the first function and the second function are different functions.

12. The domestic appliance of claim 11, wherein the first function is temperature control and the second function is a timer.

13. A domestic appliance, comprising:

at least one manually operable longitudinally or rotationally movable control device having several latching positions, said latching positions being variably adjustable, adjustment electronics electrically coupled to the control device; and a control facility electrically coupled to the adjustment electronics, wherein each of the latching positions has a characteristic that is electronically adjusted by the adjustment electronics in response to data sent by the control facility to the adjustment electronics, the adjustability of the characteristic is variable, and the characteristic is a latching sensation of the latching positions.

14. The domestic appliance of claim 13, wherein different latching sensations are assigned to at least two of the latching positions.

* * * * *